US010125572B2

(12) United States Patent
Wood et al.

(10) Patent No.: US 10,125,572 B2
(45) Date of Patent: Nov. 13, 2018

(54) CASING OR LINER BARRIER WITH REMOTE INTERVENTIONLESS ACTUATION FEATURE

(71) Applicant: BAKER HUGHES, A GE COMPANY, LLC, Houston, TX (US)

(72) Inventors: Edward T. Wood, Kingwood, TX (US); Ray P. Vincent, Houston, TX (US); Yang Xu, Houston, TX (US)

(73) Assignee: BAKER HUGHES, A GE COMPANY, LLC

( * ) Notice: Subject to any disclaimer, the term of this patent is extended or adjusted under 35 U.S.C. 154(b) by 0 days.

(21) Appl. No.: 15/347,359

(22) Filed: Nov. 9, 2016

(65) Prior Publication Data

US 2017/0058636 A1 Mar. 2, 2017

Related U.S. Application Data

(62) Division of application No. 13/733,671, filed on Jan. 3, 2013, now Pat. No. 9,562,408.

(51) Int. Cl.

| | |
|---|---|
| ***E21B 34/08*** | (2006.01) |
| ***E21B 47/18*** | (2012.01) |
| ***E21B 33/13*** | (2006.01) |
| ***E21B 34/16*** | (2006.01) |
| ***E21B 21/10*** | (2006.01) |
| *E21B 33/14* | (2006.01) |

(52) U.S. Cl.

CPC ..... *E21B 34/08* (2013.01); *E21B 21/10* (2013.01); *E21B 33/13* (2013.01); *E21B 34/16* (2013.01); *E21B 47/18* (2013.01); *E21B 33/14* (2013.01)

(58) Field of Classification Search

CPC ..... E21B 34/08; E21B 47/18; E21B 33/13; E21B 34/16; E21B 21/10; E21B 33/14

See application file for complete search history.

(56) References Cited

U.S. PATENT DOCUMENTS

| | | | | |
|---|---|---|---|---|
| 3,545,553 | A | 12/1970 | Archer, Jr. et al. | |
| 4,557,333 | A | 12/1985 | Beck | |
| 6,343,658 | B2 | 2/2002 | Webb | |
| 6,802,373 | B2 | 10/2004 | Dillenbeck et al. | |
| 7,069,992 | B2 * | 7/2006 | Lewis | E21B 21/103 166/177.4 |
| 7,090,039 | B2 | 8/2006 | Van Wijk | |
| 7,314,091 | B2 * | 1/2008 | Wagner | E21B 34/101 166/332.8 |
| 7,373,980 | B2 * | 5/2008 | Lewis | E21B 21/103 166/177.4 |
| 7,510,010 | B2 * | 3/2009 | Williamson | E21B 33/13 137/527 |
| 2002/0108747 | A1 * | 8/2002 | Dietz | E21B 34/066 166/66.7 |
| 2003/0029611 | A1 | 2/2003 | Owens | |

(Continued)

*Primary Examiner* — Michael R Wills, III
(74) *Attorney, Agent, or Firm* — Shawn Hunter

(57) ABSTRACT

A tubular string is run into a wellbore with a remotely actuated valve near a lower end adjacent a cementing shoe. The valve is triggered to operate without intervention such as by mud pulses generated at the surface and recognized by a sensor linked to a processor adjacent the valve to trigger the valve to close. Alternative actuation systems are envisioned for the valve that is located near the cementing shoe.

3 Claims, 1 Drawing Sheet

(56) References Cited

U.S. PATENT DOCUMENTS

| | | | | |
|---|---|---|---|---|
| 2005/0016734 | A1* | 1/2005 | Thompson | E21B 34/102 166/332.8 |
| 2006/0081401 | A1 | 4/2006 | Miller et al. | |
| 2007/0246225 | A1 | 10/2007 | Hailey et al. | |
| 2008/0078553 | A1 | 4/2008 | George | |
| 2011/0036588 | A1 | 2/2011 | Heironimus | |
| 2011/0186303 | A1* | 8/2011 | Scott | E21B 34/066 166/373 |
| 2011/0192598 | A1 | 8/2011 | Roddy et al. | |
| 2012/0031494 | A1* | 2/2012 | Lymberopoulos | E21B 47/12 137/1 |
| 2012/0037360 | A1* | 2/2012 | Arizmendi, Jr. | E21B 23/04 166/250.01 |
| 2012/0067594 | A1* | 3/2012 | Noske | E21B 34/08 166/373 |
| 2012/0067595 | A1 | 3/2012 | Noske et al. | |
| 2012/0080190 | A1 | 4/2012 | Rytlewski | |
| 2012/0125597 | A1 | 5/2012 | Vick, Jr. et al. | |
| 2012/0234558 | A1 | 9/2012 | Godfrey et al. | |
| 2013/0118752 | A1* | 5/2013 | Hannegan | E21B 47/0005 166/336 |
| 2014/0000870 | A1* | 1/2014 | Vick, Jr. | E21B 34/06 166/214 |

* cited by examiner

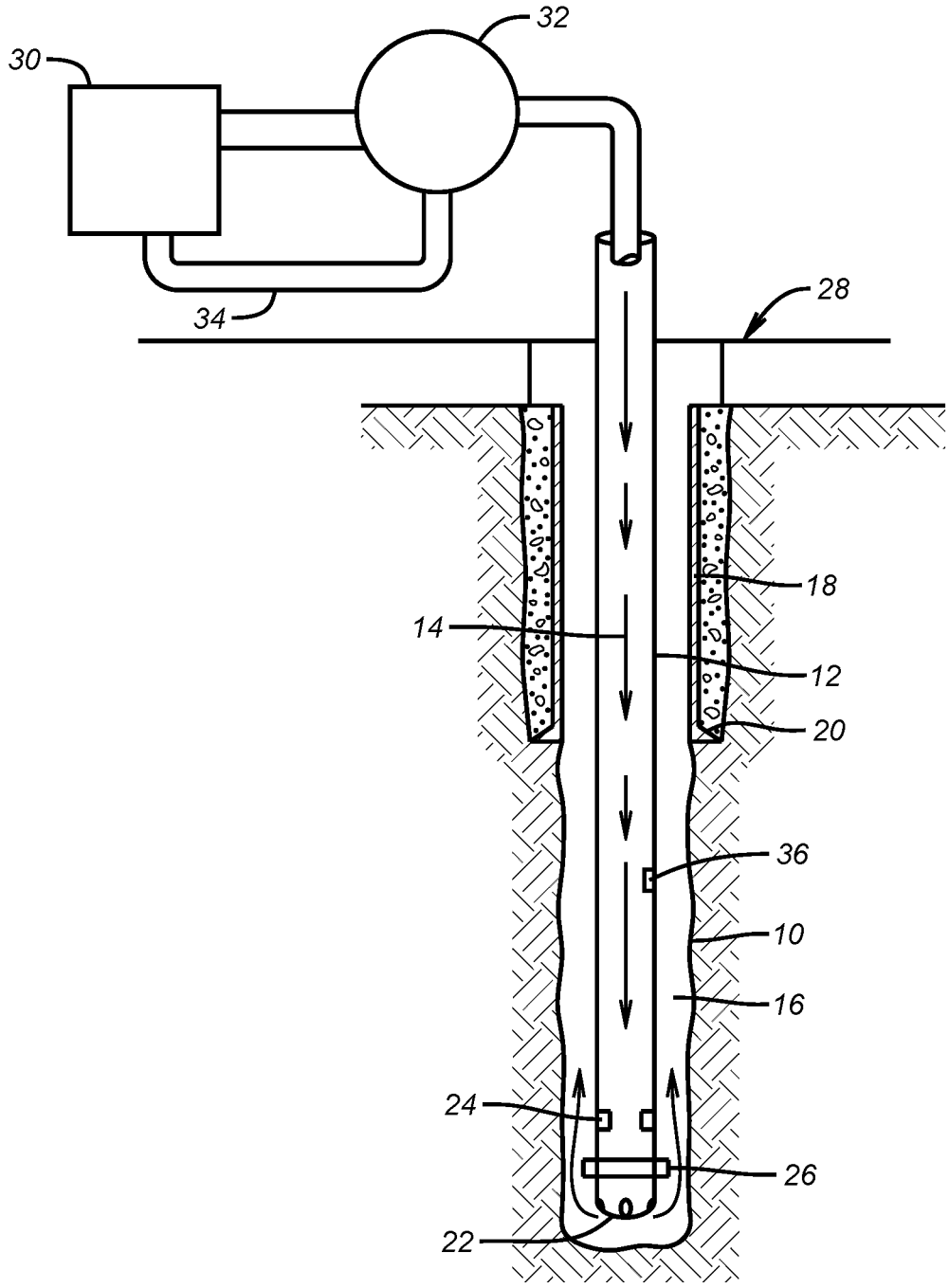
32
30
28
34
18
14
12
20
36
10
16
24
26
22

CASING OR LINER BARRIER WITH REMOTE INTERVENTIONLESS ACTUATION FEATURE

PRIORITY INFORMATION

This application is a divisional of U.S. patent application Ser. No. 13/733,671 filed on Jan. 3, 2013.

FIELD OF THE INVENTION

The field of this invention is running in and cementing tubular strings and more particularly methods for isolation independent of a shoe without a need to drop balls or plugs into the string for well control.

BACKGROUND OF THE INVENTION

When completing a well a string of casing, for example, is run in with a one way valve at the lower end known as a shoe. The one way valve is designed to allow flow out through the lower end of the casing such as when cement is delivered and then to act as a check valve to prevent cement that was pumped through the shoe and into the surrounding annular space about the casing from coming back into the casing string. Typically, after pumping in a measured quantity of cement, the cement volume is displaced through the shoe with a wiper plug that is pumped behind the cement. The wiper plug bumps in a landing collar located near the cement shoe. The design of the shoes can vary with some allowing flow in both directions until a ball is landed on a seat and parts are urged to move to convert the action of the shoe to purely a one way valve that allows cement out of the string into the surrounding annulus and prevents the cement from coming back until it can set up in the annulus. The shoe is then drilled out as the well is further extended.

One of the issues that can arise is well control during these operations. The shoe with its one way valve may not be sufficient to hold back an incipient blowout. Additionally as occurred with the Macondo well for BP in the Gulf of Mexico, the blowout preventers may not function if the string is moving them at a rapid velocity. The plugs or darts that could be used to pump down to a secured position at the lower end of the string where pressure differential from above could be used to control the well.

The present invention is a technique for well control in such instances where a valve that is in the casing or other string can be remotely actuated to shut off the string preferably near its lower end by an actuation system that is remotely actuated from preferably a surface location. A rapid response to a developing situation can be initiated to bring a well under control and close off a path to the surface through the string itself. The technique removes any need to try to introduce a ball or plug and land it for well control when time can be of the essence.

Mechanically triggered barriers have been used in applications such as casing drilling where the bottom hole assembly is pulled out through the string for bit replacement or other reasons and a packer is mechanically triggered to close off the string interior as the bottom hole assembly is removed. The closures can be inflatable packers or flappers. Some examples are US Publication 2006/0081401 and U.S. Pat. Nos. 6,343,658; 7,090,039 and 3,545,553.

Those skilled in the art will more readily appreciate other aspects of the invention from a review of the detailed description of the preferred embodiment and the associated drawing while recognizing that the full scope of the invention is to be determined from the appended claims.

SUMMARY OF THE INVENTION

A tubular string is run into a wellbore with a remotely actuated valve near a lower end adjacent a cementing shoe. The valve is triggered to operate without intervention such as by mud pulses generated at the surface and recognized by a sensor linked to a processor adjacent the valve to trigger the valve to close. Alternative actuation systems are envisioned for the valve that is located near the cementing shoe.

BRIEF DESCRIPTION OF THE DRAWING

The FIGURE is a schematic illustration showing the valve near the shoe and the surface system for its actuation in conjunction with a local sensor and processor for actuation.

DETAILED DESCRIPTION OF THE PREFERRED EMBODIMENT

Referring to the FIGURE a wellbore 10 has a string 12 which can be a casing or liner or a workstring run in with circulation represented by arrows 14 going down the string 12 and up through the annulus 16. A surface casing 18 is symbolically shown as cemented by symbol 20. Below the casing 18 the wellbore 10 is open hole. At the lower end a cement shoe is schematically represented as 22. The shoe 22 can optionally be used if cementing is to take place. Item 24 represents a signal sensor and processor that can covert a surface originated signal to operation of an actuator on the valve 26.

One way that communication occurs from the surface 28 to the valve sensor and processor 24 is by using surface pump 30 with a pulse generation device 32 that incorporates a bypass line 34 back to the pump 30 and which can also incorporate a choke valve. In this manner pressure pulses can pass through the circulating fluid represented by arrow 14 for pickup by the sensor and processor 24 to trigger the operation of the valve 26. Thus the string 12 can be closed off in a very short time when a well kick is sensed by closing valve 26 without having to try to pump a ball or a plug against the formation to get it to seat near the lower end of the string 12. It should be noted that in the event of a loss of well control the shoe 22 may not be functional to contain the pressure surge but the valve 26 and the string 12 near its lower end will have the needed pressure rating for shutting in the well and getting control. Other signaling techniques can be used such as acoustic or vibration to name a few.

Those skilled in the art will appreciate that during times of running in or cementing before the cement sets up are the times when it would be most disadvantageous to have a well control issue. As an example with the Macondo well for BP in the Gulf of Mexico the prevailing theories as to the path that the escaping hydrocarbons took was through the cement around the string being cemented. The blowout preventers were also faulted in regard to that presumed hydrocarbon flow path through the cement outside the string. However, in such situations there is also a path through the string being completed and prior techniques of trying to pump a ball or plug onto a seat may take too long to implement in some situations. Having the shutoff valve at the lower end of the string that can be actuated without any need for intervention such as delivery of a ball or a plug can make the difference between control and catastrophe. While the manner of actuating the valve can vary, the presence and location of the valve and the ability to operate it for well control without intervention improves well safety and reduces the risk of property damage and bodily injury or death during well completions.

The valve is preferably designed for slam loads based on minimal movement to obtain the closed position. A flapper, selectively retained by a shifting sleeve, or an inflatable remotely triggered to set in the string are some examples of the valve 26.

An alternative way to actuate the valve is by sensing a predetermined flow from the annulus using sensor 36 into the tubing when the valve is open. The flow can be hydrocarbons or gas from the annulus going up the string during running in or when the valve 26 is otherwise open.

The valve is useful to address a potential under balance resulting from the difference between mud weight and sea water in deep water wells such as in the Macondo situation in the Gulf of Mexico where such a valve could have prevented or minimized the damage and injury from the blowout. It is worthy of mention that there is a fundamental difference between deep water and conventional well designs. Should there be a breach in the riser pipe between the mud line and rig floor, the hydrostatic pressure resulting from the mud column in the riser will be instantaneously reduced to sea water equivalent.

The above description is illustrative of the preferred embodiment and many modifications may be made by those skilled in the art without departing from the invention whose scope is to be determined from the literal and equivalent scope of the claims below:

The invention claimed is:

1. A completion method for a tubular casing string delivered to a subterranean location, comprising:

running in a tubular casing string to a predetermined open hole location, said casing string having a shoe adjacent a lower end thereof;

providing a valve in said casing string adjacent said shoe;

cementing the tubular casing string through said shoe;

sensing during said cementing a predetermined flow from an annulus up the string as a signal for closing said valve without intervention in said casing string;

signaling said valve to slam close from at least one location of outside the open hole, within a passage of said casing string and through a wall of said casing string by communicating with an actuator for said valve associated with a processor mounted to the casing string in open hole.

2. The method of claim 1 further comprising:

signaling said valve to close after sensing the presence of hydrocarbon flow in said predetermined flow rate from said annulus up the string.

3. The method of claim 1, further comprising:

sensing gas in said predetermined flow from the annulus up the string.

* * * * *